US006772476B2

(12) United States Patent
Park

(10) Patent No.: US 6,772,476 B2
(45) Date of Patent: Aug. 10, 2004

(54) SUCTION HEAD WITH POWER BRUSH FOR VACUUM CLEANER

(75) Inventor: Jin Soo Park, Incheon (KR)

(73) Assignee: LG Electronics Inc., Seoul (KR)

( * ) Notice: Subject to any disclaimer, the term of this patent is extended or adjusted under 35 U.S.C. 154(b) by 232 days.

(21) Appl. No.: 10/044,918

(22) Filed: Jan. 15, 2002

(65) Prior Publication Data

US 2002/0194697 A1 Dec. 26, 2002

(30) Foreign Application Priority Data

Jun. 26, 2001 (KR) ..... 2001-36592

(51) Int. Cl.[7] ..... A47L 5/30
(52) U.S. Cl. ..... 15/389; 15/380; 15/392
(58) Field of Search ..... 15/377, 380, 383, 15/389, 392

(56) References Cited

U.S. PATENT DOCUMENTS 1,953,340 A * 4/1934 Doemling ..... 15/389
4,268,769 A * 5/1981 Dorner et al. ..... 310/67 R
6,314,611 B1 * 11/2001 Sauers ..... 15/376
6,323,570 B1 * 11/2001 Nishimura et al. ..... 310/67 R
6,463,623 B2 * 10/2002 Ahn et al. ..... 15/389

FOREIGN PATENT DOCUMENTS

| | | |
|---|---|---|
| JP | 54-118659 | * 9/1979 |
| JP | 11-313786 | * 11/1999 |
| JP | 2000-354569 | * 12/2000 |
| JP | 2001-371 | * 1/2001 |

* cited by examiner

*Primary Examiner*—Terrence R. Till
(74) *Attorney, Agent, or Firm*—Fleshner & Kim, LLP

(57) ABSTRACT

An improved suction head of a vacuum cleaner with a power brush is provided. A head case of the suction head is connected to a cleaner body with a connecting tube, and a power brush is positioned in the head case so as to allow the power brush to be in both rotary and linear motion. A two degree-of-freedom motor installed on both a moving frame and a fixed frame of the power brush allows the power brush to move in both a rotary and linear fashion. Thus, it is possible to reduce the size of the suction head while also improving cleaning performance.

12 Claims, 4 Drawing Sheets

SUCTION HEAD WITH POWER BRUSH FOR VACUUM CLEANER

BACKGROUND OF THE INVENTION

1. Field of the Invention

The present invention relates to a suction head of a vacuum cleaner, and more particularly, to a suction head of a vacuum cleaner with a power brush that rotatively contacts objects to be cleaned and separates alien substances from the objects to be cleaned, to thus let the vacuum cleaner easily suck up the alien substances.

2. Description of the Background Art

In general, vacuum cleaners perform cleaning by collecting alien substances such as dust, which exist in objects to be cleaned, through strong suction force generated by the operation of a fan motor assembly.

Among such vacuum cleaners, there exists a vacuum cleaner with a power brush referred to as an agitator and positioned in a suction head, which rotatively contacts the objects to be cleaned and separates the alien substances from the objects to be cleaned, to thus let the vacuum cleaner easily suck up the alien substances from the objects to be cleaned. Accordingly, it is possible to improve a cleaning performance.

As shown in FIG. 1, the vacuum cleaner with the power brush includes a cleaner body 1, in which a fan motor assembly for generating suction force so as to suck up the alien substances such as dust, which exist in the objects to be cleaned, is loaded, a connecting tube 5 longitudinally connected from the cleaner body 1 and operating as a path, through which the alien substances are sucked up into, and a suction head 10 connected to the end of the connecting tube 5 so that the alien substances can be sucked up into the suction head 10 in a state where the suction head 10 contacts the objects to be cleaned.

In particular, a power brush 20 rotatively contacting the objects to be cleaned, the power brush 20 for separating the alien substances existing in the objects to be cleaned from the objects is installed In the suction head 10.

The structure of the suction head with the power brush will now be described with reference to FIG. 2.

The suction head 10 includes a head case 11, which is connected to the connecting tube 5 shown in FIG. 1 and in which a suction hole 15 for sucking up the alien substances is formed on the bottom, the power brush 20 rotatively contacting the objects to be cleaned since some of the power brush 20 protrude from the inside of the head case 11 to the outside through the suction hole 15, rotation shafts 25 rotatably installed in the head case 11, the rotation shafts 25 for supporting the power brush 20, an electric motor 30 fixed in the head case 11, the electric motor 30 for rotatively operating the power brush 20 by rotating the rotation shafts 25.

The power brush 20 is cylindrical. The rotation shafts 25 are fixed to both center portions of the power brush 20. Brushes 22 spirally arranged with respect to the direction of the rotation shafts 25 so as to contact the objects to be cleaned are installed on the outer circumference of the power brush 20.

The electric motor 30 are fixed to be parallel to the power brush 20 and the rotation shafts 25 in the head case 11. Pulleys 33 and 34 are included in the shaft 31 of the electric motor 30 and the rotation shaft 25, respectively. The pulleys are mutually connected to a belt 35, to thus transmit the operating power generated by the electric motor 30 to the power brush 20.

In the vacuum cleaner with the power brush according to a conventional technology, having the above structure, when the fan motor assembly in the cleaner body 1 operates, suction force is generated in the head case 11 of the suction head 10. At this time, the alien substances such as dust existing in the objects to be cleaned are sucked up through the suction hole 15 of the head case 11.

When power is applied to the electric motor 30 in the suction head 10, the power brush 20 rotates. The rotating power brush 20 rotatively contacts the objects to be cleaned and separates the alien substances from the objects to be cleaned. The separated alien substances are sucked up through the suction hole 15 by the suction force generated in the cleaner body 1.

In the suction head of the vacuum cleaner with the power brush according to the conventional technology, since the electric motor 30 is installed outside the power brush 20 in order to rotate the power brush 20, a space for installing the electric motor 30 is required in the suction head 10. Accordingly, the size of the suction head 10 becomes relatively larger.

In the suction head of the vacuum cleaner with the power brush according to the conventional technology, since the operating power of the electric motor 30 is transmitted to the power brush 20 by the belt 35, when the vacuum cleaner is used for a long time, the belt 35 can become loose and the power brush 20 is not smoothly rotated. Accordingly, efficiency of cleaning deteriorates.

In particular, in the suction head of the vacuum cleaner with the power brush according to the conventional technology, since the power brush contacts the objects to be cleaned, to thus separate the alien substances from the objects to be cleaned, only in the direction, where the power brush rotates, the alien substances attached to the objects to be cleaned are not effectively removed. Accordingly, it is restricted to improve a cleaning performance.

SUMMARY OF THE INVENTION

Therefore, an object of the present invention is to provide a suction head of a vacuum cleaner with a power brush, which is capable of being compactly designed by installing a motor for providing operating power to the power brush in the power brush, to thus reduce the size of the suction head.

Another object of the present invention is to provide a suction head of a vacuum cleaner with a power brush, which is capable of improving a cleaning performance by letting the power brush be in a linear motion as well as in a rotary motion, to thus improve ability of separating the alien substances from the objects to be cleaned.

To achieve these and other advantages and in accordance with the purposes of the present invention, as embodied and broadly described herein, there is provided a suction head of a vacuum cleaner with a power brush, comprising a head case connected to a cleaner body through a connecting tube and having a suction hole on the bottom, a power brush positioned in the head case, some part of which protrudes outward the head case through the suction hole, to thus contact objects to be cleaned, supporting means fixed to the head case, the supporting means for supporting the power brush to be in a rotary motion and in a linear motion, a moving frame and a fixed frame formed to be cylindrical and fixed to the power brush and the supporting means in the power brush, and a two degree-of-freedom motor installed to correspond to the moving frame and the fixed frame, the two degree-of-freedom motor for rotatively operating and linearly moving the power brush.

The two degree-of-freedom motor comprises a rotary operating part for rotatively driving the power brush due to a mutual operation between a rotary operating magnet installed in the moving frame and a rotary operating coil installed in the fixed frame and a linear operating part for linearly operating the power brush due to a mutual operation between a linear operating magnet installed in the moving frame and a linear operating coil installed in the fixed frame.

Elastic means for providing elasticity are installed between the power brush and the head case so as to generate power corresponding to operating power of the linear operating part.

The rotary operating coil and the linear operating coil are installed in the fixed frame fixed to the supporting means and the rotary operating magnet and the linear operating magnet are installed in the moving frame fixed to the power brush.

The moving frame having two supporting portions of a double cylindrical structure is fixed to the power brush and the fixed frame is fixed to the supporting means so that some part of the fixed frame is inserted into a space between the two supporting portions of the moving frame.

The rotary operating coil and the linear operating coil are installed on the inner and outer circumferences of the fixed frame, respectively, and the rotary operating magnet and the linear operating magnet are installed in the two supporting portions of the moving frame, where the rotary operating magnet and the linear operating magnet face the rotary operating coil and the linear operating coil.

A connecting portion for integrally connecting the two supporting portions is formed in the moving frame and a plurality of holes are formed in the connecting portion so that air can pass through.

The supporting portion positioned inside between the two supporting portions of the moving frame has a bearing means between the supporting portion and the supporting means so that the supporting portion can rotatively and linearly move in a state where the supporting portion is supported by the supporting means.

The bearing means for supporting the power brush is comprised between the power brush and the supporting means so that the power brush can rotatively and linearly move.

Cooling fans for forcibly blowing air into the power brush are installed on one surface or both surfaces of the power brush.

The supporting means comprises a supporting shaft, both ends of which are fixed to the head case, and the bearing means installed between the supporting shaft and the power brush, the bearing means for supporting the power brush so that the power brush can rotatively and linearly move.

The supporting shaft comprises shaft supporting portions protruding above the inner surface of the power brush, the shaft supporting portions for fixing both ends of the supporting shaft and the bearing means comprises the bearing supporting portion and a sleeve bearing contacting the power brush in the direction of a circumference.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An embodiment of a suction head of a vacuum cleaner with a power brush according to the present invention will now be described with reference to the attached drawings.

A plurality of embodiments of the suction head of the vacuum cleaner with the power brush according to the present invention can exist. However, a preferred embodiment will now be described.

Figure 1:
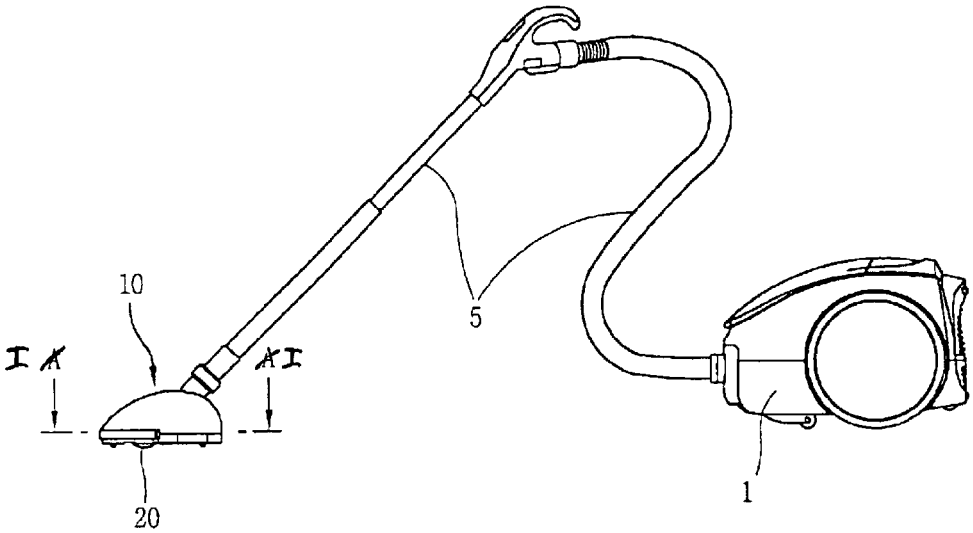
FIG. 1 CONVENTIONAL ART
FIG. 1 is a side view showing a vacuum cleaner according to a conventional technology.
Figure 2:
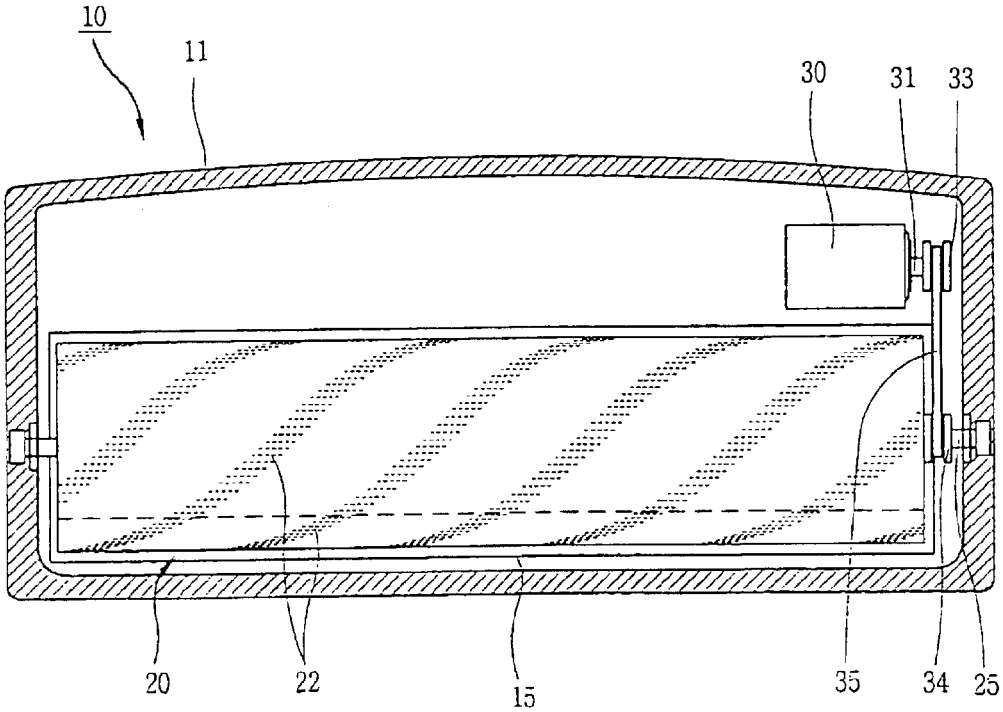
FIG. 2 CONVENTIONAL ART
FIG. 2 is a horizontal sectional view taken along the line I—I of FIG. 1, showing a suction head of a vacuum cleaner with a power brush according to a conventional technology.
Figure 3:
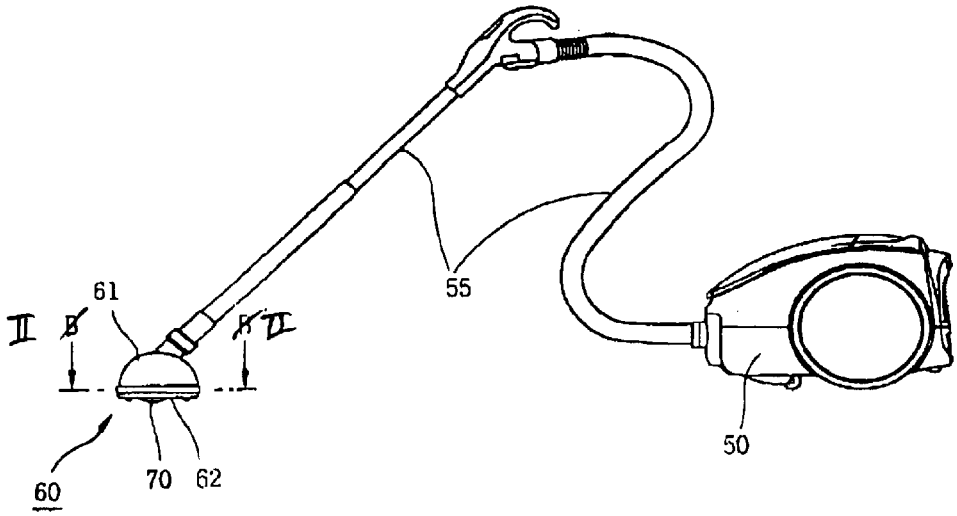
FIG. 3 is a side view showing a vacuum cleaner according to the present invention.
Figure 4:
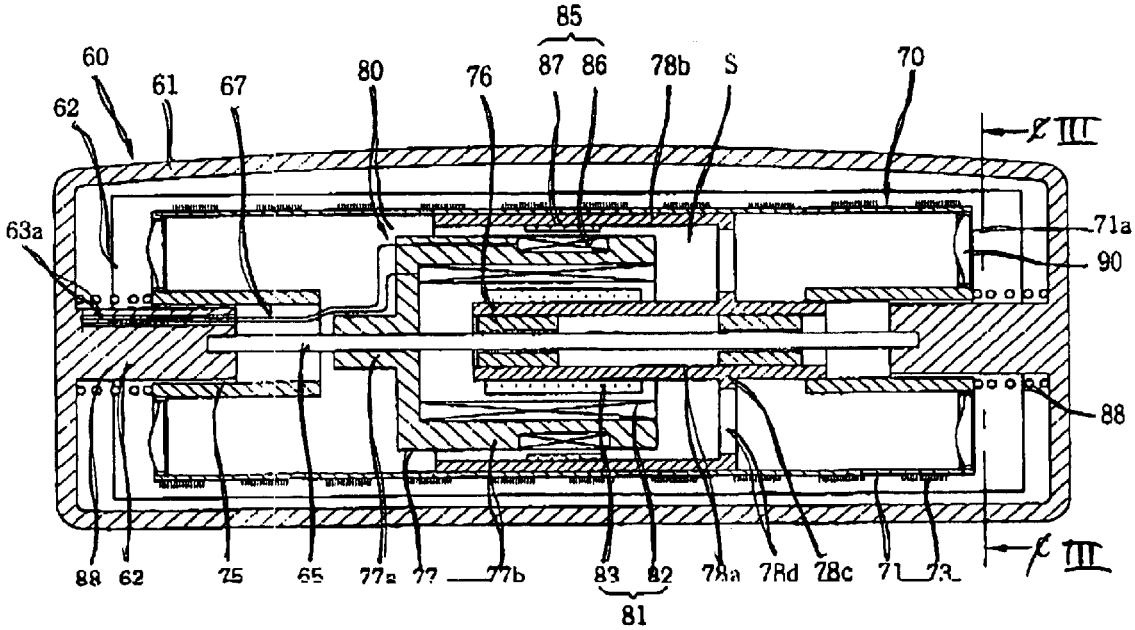
FIG. 4 is a horizontal sectional view taken along the line II—II of FIG. 3, showing a suction head of a vacuum cleaner with a power brush according to an embodiment of the present invention.

FIG. 3 is a side view showing a vacuum cleaner with a suction head according to the present invention. FIG. 4 is a horizontal sectional view taken along the line II—II of FIG. 3, showing a suction head of a vacuum cleaner with a power brush according to an embodiment of the present invention.

Figure 5:
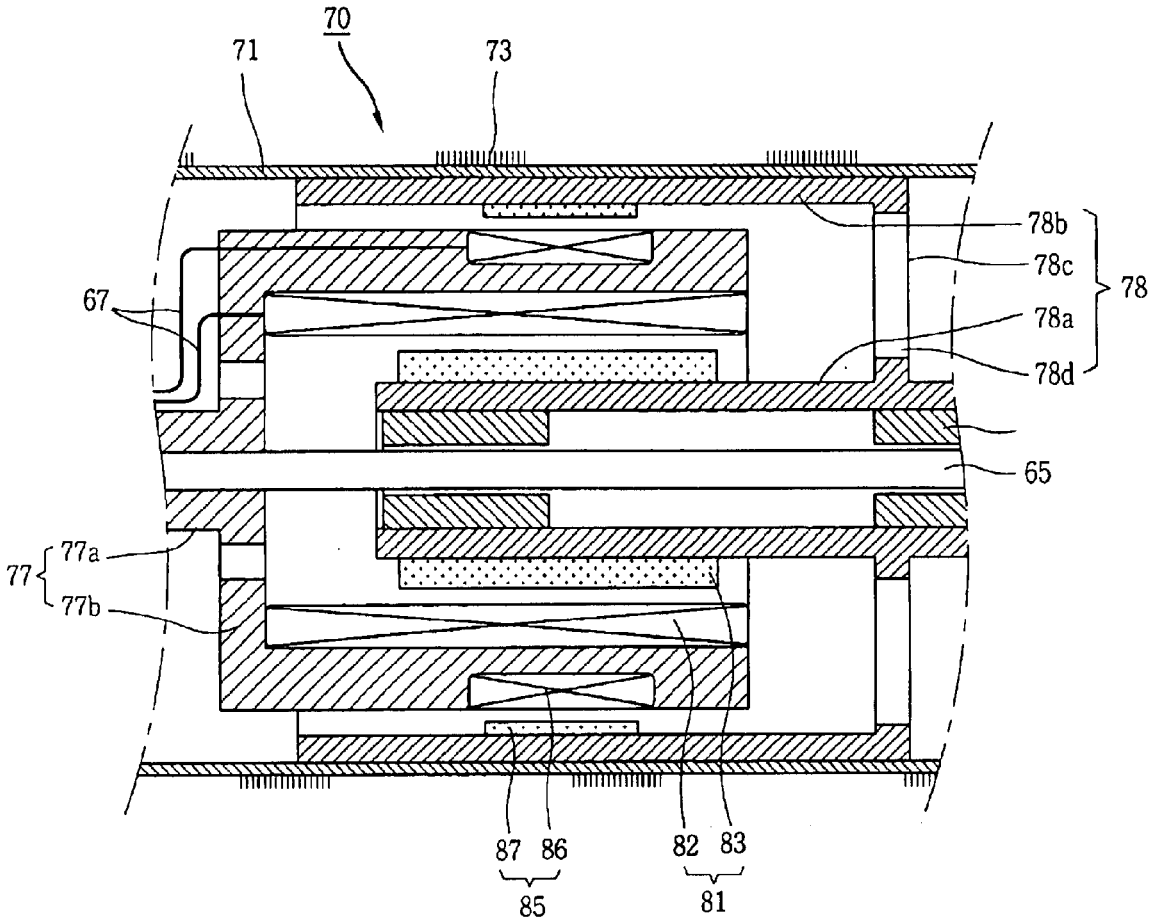
FIG. 5 is a detailed view showing a two degree-of-freedom motor of FIG. 4.
Figure 6:
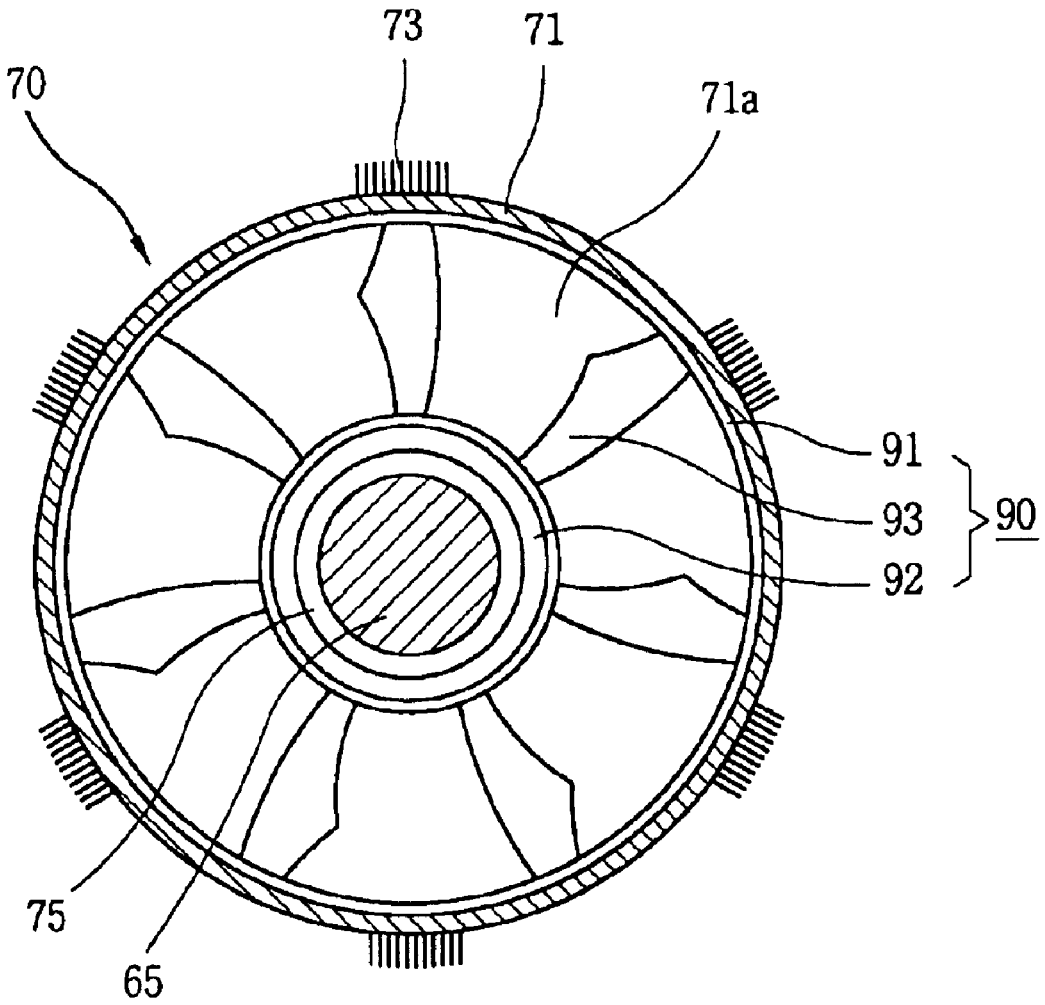
FIG. 6 is a side view of a power brush taken along the line III—III of FIG. 4.

FIG. 5 is a detailed view showing a two degree-of-freedom motor of FIG. 4. FIG. 6 is a side view of a power brush taken along the line III—III of FIG. 4.

Referring to FIG. 3, a vacuum cleaner includes a cleaner body 50 having a fan motor assembly for generating suction force and a collecting chamber for collecting alien substances, a connecting tube 55, which is longitudinally extended from the cleaner body 50 and operates as a path for sucking up the alien substances, and a suction head 60 positioned in the end of the connecting tube 55 near the objects to be cleaned, the suction head 60 for sucking up the alien substances such as dust.

A power brush 70 rotatively contacting the objects to be cleaned, the power brush 70 for separating the alien substances from the objects to be cleaned is installed in the suction head 60.

Referring to FIG. 4, the suction head 60 a head case 61 connected to the cleaner body 50 through the connecting tube 55, a supporting shaft 65 installed in the longitudinal direction of the head case in the head case 61, the power brush 70 combined with the supporting shaft so as to relatively move in the rotation direction and the linear direction with respect to the supporting shaft 65, a rotary operating part 81 arranged in the power brush 70, and a two degree-of-freedom motor 80 including the rotary operating part 81 arranged in the power brush 70, the rotary operating part 81 for rotatively operating the power brush 70 and a linear operating part 85 arranged in the power brush 70, the linear operating part 85 for linearly operating the power brush 70.

Shaft supporting portions 63 are formed to protrude above both inner walls of the head case 61. A supporting shaft 65 is fixed between the shaft supporting portions 63 along the longitudinal direction of the suction hole 62.

A cable hole 63*a* is formed in at least one shaft supporting portion 63 so that power cables 67 for supplying power to the two degree-of-freedom motor 80 can pass through the cable hole 63*a*.

The power brush 70 includes a cylindrical body 71, in which opening portions 71*a* are formed on both walls of the cylindrical body 71 and a holding space is formed inside the cylindrical body 71, and a brush part 73 installed on the outer circumference of the body part 71, to thus contact the objects to be cleaned.

Cooling fans 90 are installed on both opening portions 71*a* of the body part 71 so that air can be blown into the body part 71, to thus cool the two degree-of-freedom motor 80. As shown in FIG. 6, the cooling fan 90 includes an outer ring 91 and an inner ring 92 fixed to the opening portions 71*a* of the body 71 so that the outer ring 91 and the inner ring 92 have the same center and a plurality of blades 93 connected between the outer ring 91 and the inner ring 92 to have a radial structure, the blades 93 for forcibly blowing air.

A cylindrical sleeve bearing 75 is installed to be in a rotary motion and a linear motion around the shaft supporting portion 63 inside the inner ring 92.

The two degree-of-freedom motor 80 is loaded in the power brush 70. The two degree-of-freedom motor 80 will now be described with reference to FIGS. 4 and 5.

The two degree-of-freedom motor 80 is installed in a fixed frame 77 fixed to the supporting shaft 65 and a moving frame 78 fixed to the body 71.

In the two degree-of-freedom motor 80, the rotary operating part 81 for rotatively driving the power brush 70 includes a rotary operating magnet 83 installed in the moving frame 78 and integrally and rotatably connected to the body part 71 and a rotary operating coil 82 installed on the outer circumference of the rotary operating magnet 83 to be separated from each other by a predetermined distance in the fixed frame 77, the rotary operating coil 82 for mutually operating with the rotary operating magnet 83, to thus generate rotary operating power.

In the two degree-of-freedom motor 80, the linear operating part 85 for linearly reciprocating the power brush 70 includes a linear operating magnet 87 installed in the moving frame 78 and integrally combined with the body part 71 to be in the linear motion and a linear operating coil 86 installed on the inner circumference of the linear operating magnet 87 to be separated from each other by a predetermined distance in the fixed frame 77, the linear operating coil 86 mutually operating with the linear operating magnet 87, to thus generate linear operating power.

The fixed frame 77 includes a fixed portion 77*a* fixed to the supporting shaft 65 and a winding portion 77*b*, which is extended from the fixed portion 77*a* to be cylindrical and around which the rotary operating coil 82 and the linear operating coil 86 are wound.

The rotary operating coil 82 corresponding to the rotary operating magnet 83 is installed on the inner circumference of the fixed frame 77. The linear operating coil 86 corresponding to the linear operating magnet 87 is installed on the outer circumference of the fixed frame 77.

The power cables 67 for supplying the power to the linear operating coil 86 and the rotary operating coil 82 are drawn out of the body part 71 through the cable hole 63*a* of the shaft supporting portion 63.

The moving frame 78 is positioned in the inner center region of the body part 71 of the power brush 70 and is integrally combined with the body part 71 by being press fitted to the body part 71 so as to support the rotary operating magnet 83 and the linear operating magnet 87.

The moving frame 78 includes a cylindrical first supporting portion 78*a* arranged around the supporting shaft 65 to be in a relative motion, the first supporting portion 78*a* for supporting the rotary operating magnet 83, a cylindrical second supporting portion 78*b* formed to have a radius larger than the radius of the first supporting portion 78*a* and fixed on the inner surface of the body part 71, the second supporting portion 78*b* for supporting the linear operating magnet 87; and a connecting portion 78*c* connected between the first supporting portion 78*a* and the second supporting portion 78*b* and having a plurality of holes 78*d*, through which air can pass.

A sleeve bearing 76 for supporting the moving frame 78 and the body part 71 to be in the rotary motion and in a sliding motion with respect to the supporting shaft 65 is installed on the inner circumference of the first supporting portion 78*a*.

A space S is formed between the first supporting portion 78*a* and the second supporting portion 78*b* so that a winding portion 77*b* of the fixed frame 77 or supporting the rotary operating coil 82 and the linear operating coil 86 is inserted into the space S.

Springs 88 for providing elasticity so that the power brush 70 continuously moves from side to side when the power brush is in the linear motion are installed between both surfaces of the power brush 70 and the inner wall of the head case 61.

The operation of the suction head of the vacuum cleaner with the power brush according to the present invention, which has the above structure, will now be described.

When the power is applied to the fan motor assembly of the cleaner body 50, to thus rotate the fan motor assembly, the suction force is generated in the head case 61. Accordingly, air around the objects to be cleaned and the alien substances such as dust can be sucked up into the suction hole in the head case 61.

When the power is applied to the rotary operating coil 82 in order to rotatively operate the power brush 70, a magnetic field is formed around the rotary operating coil 82. At this time, the power brush 70 including the moving frame 78 is in the rotary motion centering on the supporting shaft 65 due to a mutual operation between the flux of the rotary operating coil 82 and the magnetic field of the rotary operating magnet 83.

The cooling fans 90 installed in both opening portions 71 a of the body part 71 rotate together with the body part 71 and forcibly blow air into the body part 71, to thus cool the two degree-of-freedom motor 80.

Therefore, when the power brush 70 rotates, a brush part 73 attached to the outer circumference of the body part 71 rotatively contacts the objects to be cleaned and separates the alien substances from the objects to be cleaned. The alien substances separated from the objects to be cleaned are sucked up into the vacuum cleaner due to the suction force of the cleaner body 50.

When the power is applied to the linear operating coil 86 in order to linearly operate the power brush 70 along the direction of the supporting shaft 65, the flux flows around the linear operating coil 86. At this time, the power brush 70 moves to one side along the direction of the supporting shaft 65 due to the mutual operation between the flux formed by the linear operating coil 86 and the magnetic field of the linear operating magnet 87.

When the direction of the power applied to the linear operating coil 86 changes, the body part 71 moves to the opposite direction. When the power is alternately applied to the linear operating coil 86, the body part 71 reciprocates along the direction of the supporting shaft 65.

Therefore, when the power brush 70 is in a linear reciprocating motion, the brush part 73 formed on the outer circumference of the body part 71 contacts the objects to be cleaned while moving from side to side, to thus separate the alien substances from the objects to be cleaned. The alien substances separated from the objects to be cleaned are sucked up into the cleaner body 50 through the suction hole 62. Accordingly, the alien substances are removed.

When the power is simultaneously applied to the rotary operating coil 82 and the linear operating coil 86, the power brush 70 is in the linear reciprocating motion along the direction of the supporting shaft 65 while rotating centering around the supporting shaft 65, to thus more easily separate the alien substances from the objects to be cleaned. Accordingly, it is possible to improve a cleaning performance.

In the embodiment according to the present invention, the rotary operating part 81 is arranged inside along the direction of the radius of the power brush 70 and the linear operating part 85 is arranged outside the rotary operating part 81. However, the linear operating part 85 can be arranged inside and the rotary operating part 81 can be arranged outside the linear operating part 85

In the suction head of the vacuum cleaner with the power brush according to the present invention, the two degree-of-freedom motor is included in the power brush. Accordingly, the power brush can remove the alien substances while linearly and/or rotatively contacting the objects to be cleaned. Therefore, it is possible to easily remove the alien substances, to thus improve the cleaning performance.

In the suction head of the vacuum cleaner with the power brush according to the present invention, since the two degree-of-freedom motor is installed in the power brush, it is possible to reduce the size of the suction head. Accordingly, it is possible to compactly design the vacuum cleaner.

In the suction head of the vacuum cleaner with the power brush according to the present invention, the cooling fans are installed on both surfaces of the power brush, it is possible to effectively cool the two degree-of-freedom motor installed in the power brush.

What is claimed is:

1. A suction head of a vacuum cleaner with a power brush, comprising:

a head case connected to a cleaner body through a connecting tube and having a suction hole on the bottom;

a power brush positioned in the head case, some part of which protrudes outward the head case through the suction hole, to thus contact objects to be cleaned;

supporting means fixed to the head case, the supporting means for supporting the power brush to be in a rotary motion and in a linear motion;

a moving frame and a fixed frame formed to be cylindrical and fixed to the power brush and the supporting means in the power brush; and a two degree-of-freedom motor installed to correspond to the moving frame and the fixed frame, the two degree-of-freedom motor for rotatively operating and linearly moving the power brush.

2. The suction head of claim 1, wherein the two degree-of-freedom motor comprises a rotary operating part for rotatively driving the power brush due to a mutual operation between a rotary operating magnet installed in the moving frame and a rotary operating coil installed in the fixed frame and a linear operating part for linearly operating the power brush due to a mutual operation between a linear operating magnet installed in the moving frame and a linear operating coil installed in the fixed frame.

3. The suction head of claim 2, wherein elastic means for providing elasticity are installed between the power brush and the head case so as to generate power corresponding to operating power of the linear operating part.

4. The suction head of claim 2, wherein the rotary operating coil and the linear operating coil are installed in the fixed frame fixed to the supporting means, and wherein the rotary operating magnet and the linear operating magnet are installed in the moving frame fixed to the power brush.

5. The suction head of claim 2, wherein the moving frame having two supporting portions of a double cylindrical structure is fixed to the power brush, and wherein the fixed frame is fixed to the supporting means so that some part of the fixed frame is inserted into a space between the two supporting portions of the moving frame.

6. The suction head of claim 5, wherein the rotary operating coil and the linear operating coil are installed on the inner and outer circumferences of the fixed frame, respectively, and wherein the rotary operating magnet and the linear operating magnet are installed in the two supporting portions of the moving frame, where the rotary operating magnet and the linear operating magnet face the rotary operating coil and the linear operating coil.

7. The suction head of claim 5, wherein a connecting portion for integrally connecting the two supporting portions is formed in the moving frame and a plurality of holes are formed in the connecting portion so that air can pass through.

8. The suction head of claim 5, wherein the supporting portion positioned inside between the two supporting portions of the moving frame has a bearing means between the supporting portion and the supporting means so that the supporting portion can rotatively and linearly move in a state where the supporting portion is supported by the supporting means.

9. The suction head of claim 1, wherein the bearing means for supporting the power brush is comprised between the power brush and the supporting means so that the power brush can rotatively and linearly move.

10. The suction head of claim 1, wherein cooling fans for forcibly blowing air into the power brush are installed on one surface or both surfaces of the power brush.

11. The suction head of claim 1, wherein the supporting means comprises a supporting shaft, both ends of which are fixed to the head case, and the bearing means installed between the supporting shaft and the power brush, the bearing means for supporting the power brush so that the power brush can rotatively and linearly move.

12. The suction head of claim 11, wherein the supporting shaft comprises shaft supporting portions protruding above the inner surface of the power brush, the shaft supporting portions for fixing both ends of the supporting shaft, means comprises the bearing supporting portion and a sleeve bearing the power brush in the direction of a circumference.

* * * * *